US009117435B2

(12) United States Patent
Huang et al.

(10) Patent No.: US 9,117,435 B2
(45) Date of Patent: Aug. 25, 2015

(54) VOLUME AMPLIFYING ASSEMBLY AND PORTABLE ELECTRONIC DEVICE PACKING CASE USING THE VOLUME AMPLIFYING ASSEMBLY

(71) Applicant: FIH (Hong Kong) Limited, Kowloon (HK)

(72) Inventors: Chiu-Chu Huang, New Taipei (TW); Ping-Chu Tsai, New Taipei (TW)

(73) Assignee: FIH (Hong Kong) Limited, Kowloon (HK)

( * ) Notice: Subject to any disclaimer, the term of this patent is extended or adjusted under 35 U.S.C. 154(b) by 0 days.

(21) Appl. No.: 14/157,538

(22) Filed: Jan. 17, 2014

(65) Prior Publication Data

US 2015/0034411 A1 Feb. 5, 2015

(30) Foreign Application Priority Data

Aug. 1, 2013 (TW) ..... 102127555 A

(51) Int. Cl.

| | |
|---|---|
| ***H04R 1/02*** | (2006.01) |
| ***G10K 11/00*** | (2006.01) |
| ***H04R 1/34*** | (2006.01) |
| ***H04R 1/42*** | (2006.01) |

(52) U.S. Cl.

CPC ..... *G10K 11/002* (2013.01); *H04R 1/34* (2013.01); *H04R 1/42* (2013.01); *H04R 2205/021* (2013.01)

(58) Field of Classification Search

CPC ..... G10K 11/002; G10K 11/32; G10K 11/08; H04R 1/02; H04R 1/42; H04R 1/34; H04R 1/345; H04R 2205/021

USPC ..... 181/199; 379/455

See application file for complete search history.

(56) References Cited

U.S. PATENT DOCUMENTS

| | | | | |
|---|---|---|---|---|
| 8,256,568 | B2 * | 9/2012 | Lin | 181/179 |
| 8,428,665 | B1 * | 4/2013 | McLaughlin et al. | 455/575.1 |
| 8,520,370 | B2 * | 8/2013 | Waitzman et al. | 361/679.01 |
| 8,522,917 | B1 * | 9/2013 | Oh et al. | 181/192 |
| 2005/0121121 | A1 * | 6/2005 | Wang | 150/117 |
| 2010/0183179 | A1 * | 7/2010 | Griffin et al. | 381/337 |
| 2010/0219012 | A1 * | 9/2010 | Baumbach | 181/177 |
| 2011/0170725 | A1 * | 7/2011 | Liu | 381/338 |
| 2012/0063630 | A1 * | 3/2012 | Maezawa et al. | 381/386 |
| 2012/0140970 | A1 * | 6/2012 | Kim et al. | 381/340 |
| 2012/0303146 | A1 * | 11/2012 | Genov et al. | 700/94 |
| 2014/0105425 | A1 * | 4/2014 | Chu et al. | 381/120 |

* cited by examiner

*Primary Examiner* — Jeremy Luks

(74) *Attorney, Agent, or Firm* — Novak Druce Connolly Bove + Quigg LLP

(57) ABSTRACT

A portable electronic device packing case includes a packing body and a volume amplifying assembly received in the packing body. The volume amplifying assembly includes a volume amplifying body. The volume amplifying body includes a top wall formed on one end of the volume amplifying body, a side wall connected to the top wall, and a supporting member for supporting a portable electronic device positioned in the volume amplifying body. The top wall defines a plurality of sound holes therein, and the supporting member has a bottom surface defining a plurality of sound transmitting holes. The top wall, the side wall, and the supporting member cooperatively define a sound chamber for sound emitted by the electronic device to resonate therein.

20 Claims, 6 Drawing Sheets

VOLUME AMPLIFYING ASSEMBLY AND PORTABLE ELECTRONIC DEVICE PACKING CASE USING THE VOLUME AMPLIFYING ASSEMBLY

FIELD

The present disclosure generally relates to a volume amplifying assembly, and particularly to a volume amplifying assembly for a portable electronic device and a portable electronic device packing case using the volume amplifying assembly.

BACKGROUND

Packing structures of portable electronic devices (such as mobile phones and personal digital assistants) are used to protect the electronic devices from damage. However, the packing structures are usually discarded by customers, which results in environmental pollution and waste.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one." The references "a plurality of" and "a number of" mean "at least two."

Figure 1:
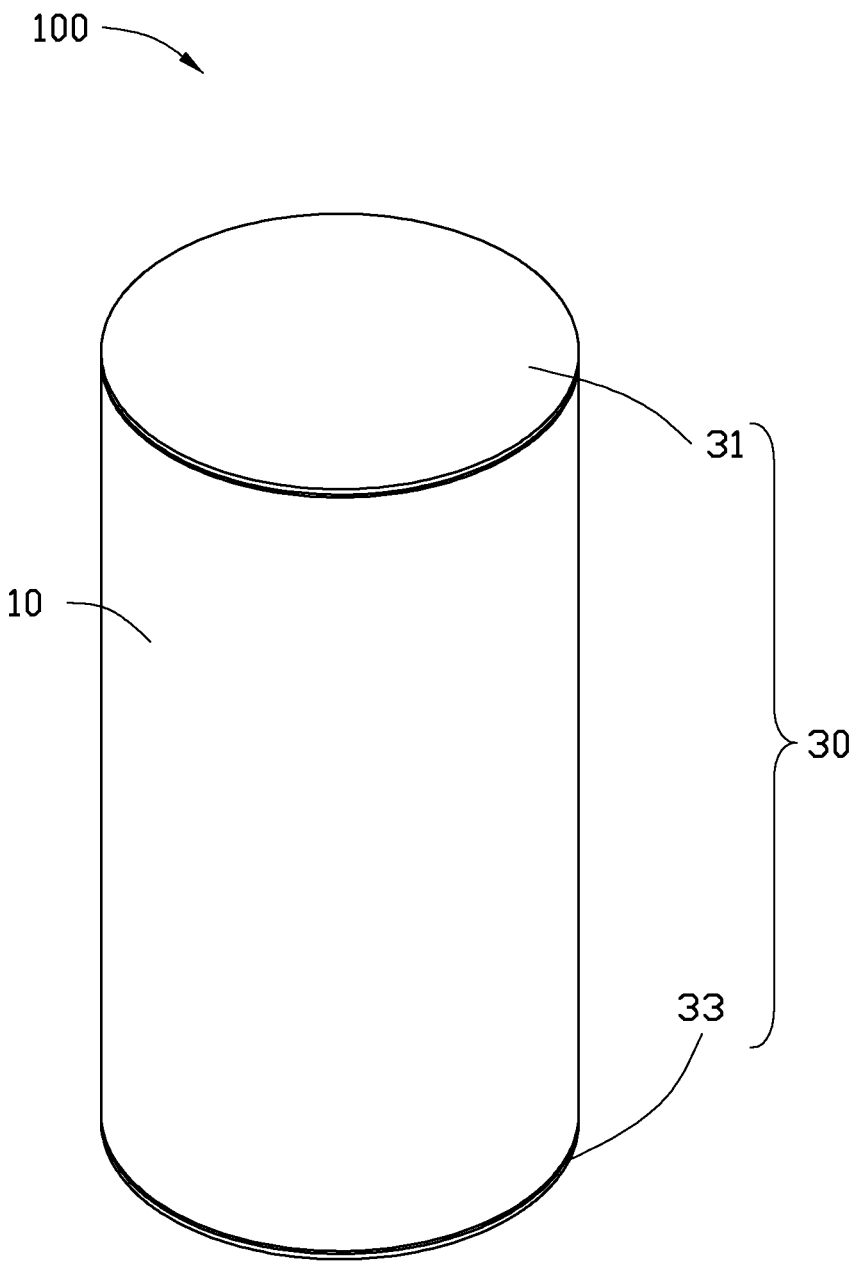
FIG. 1 is an isometric view of an embodiment of a portable electronic device packing case having a volume amplifying body.
Figure 2:
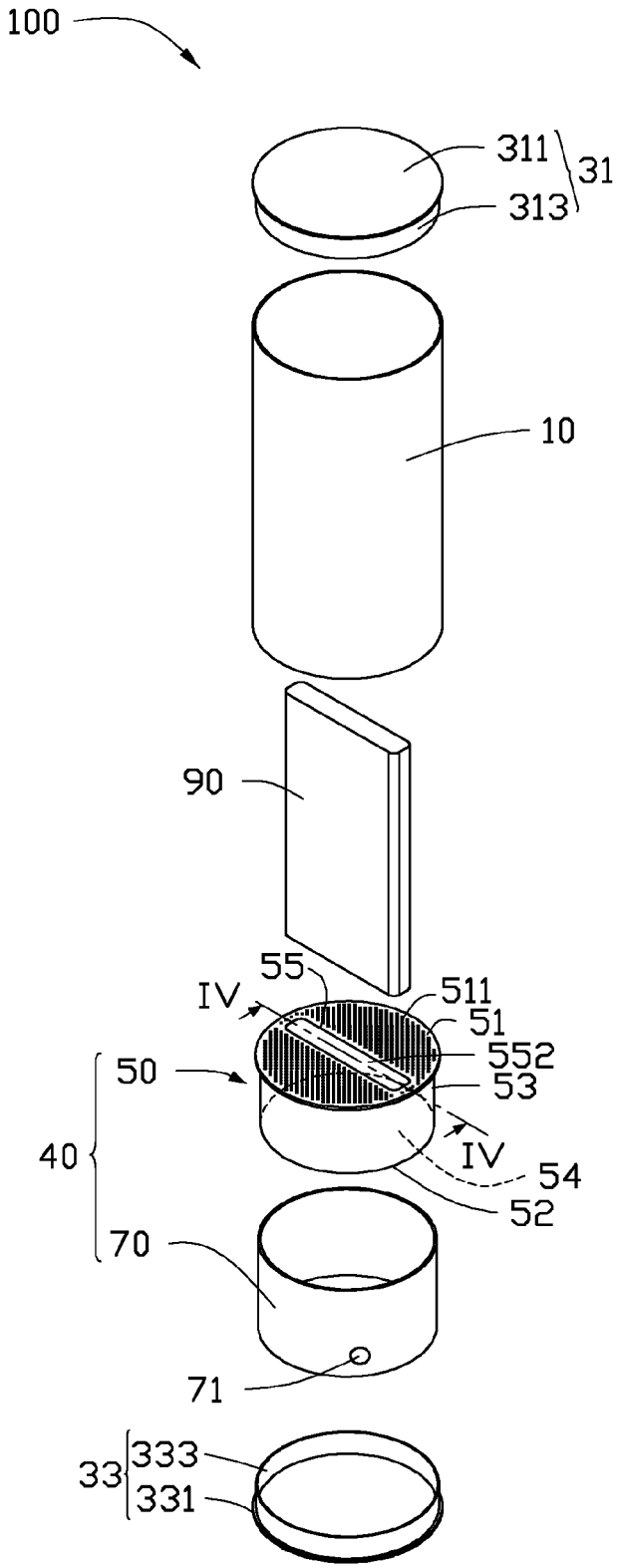
FIG. 2 is an exploded view of the packing case of FIG. 1.
Figure 3:
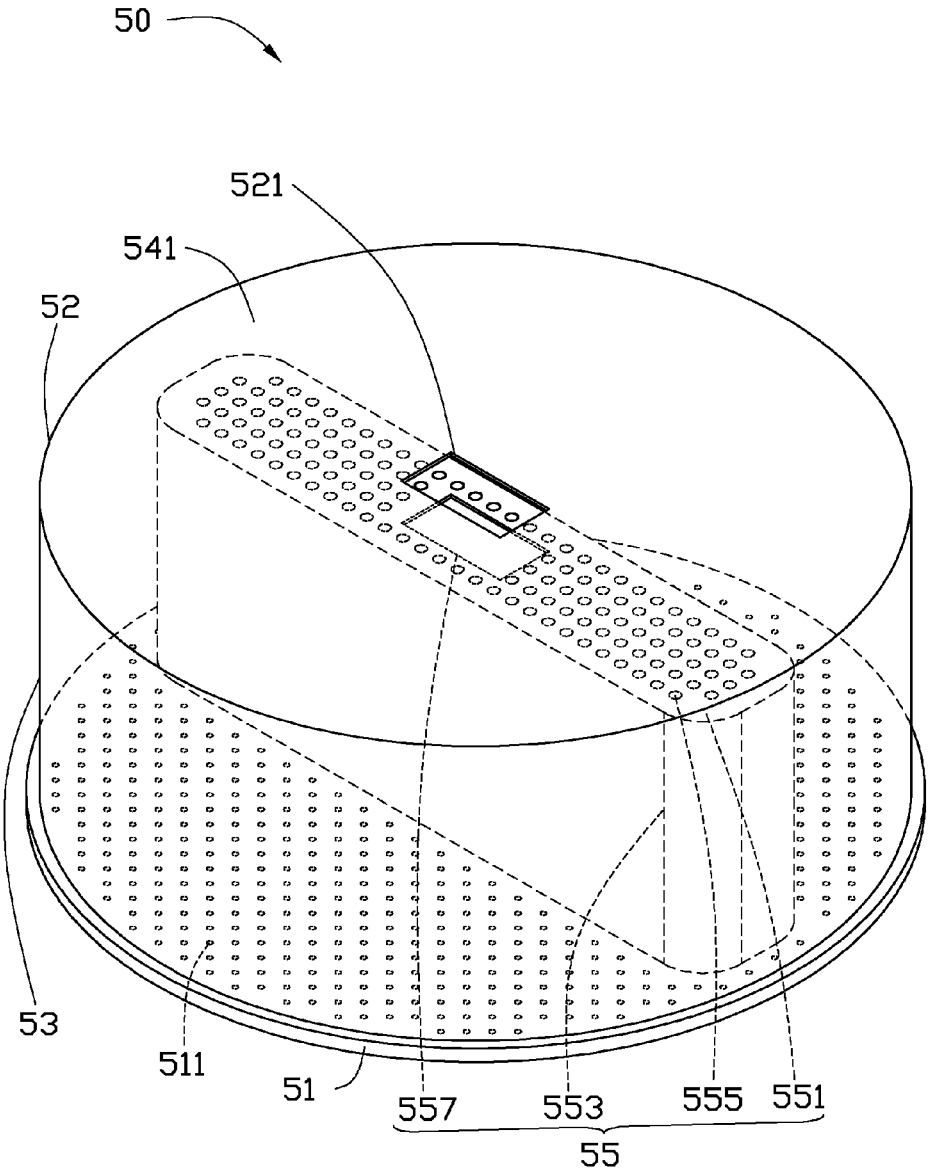
FIG. 3 is an enlarged view of the volume amplifying body of the packing case as shown in FIG. 2, but viewed from another angle.
Figure 4:
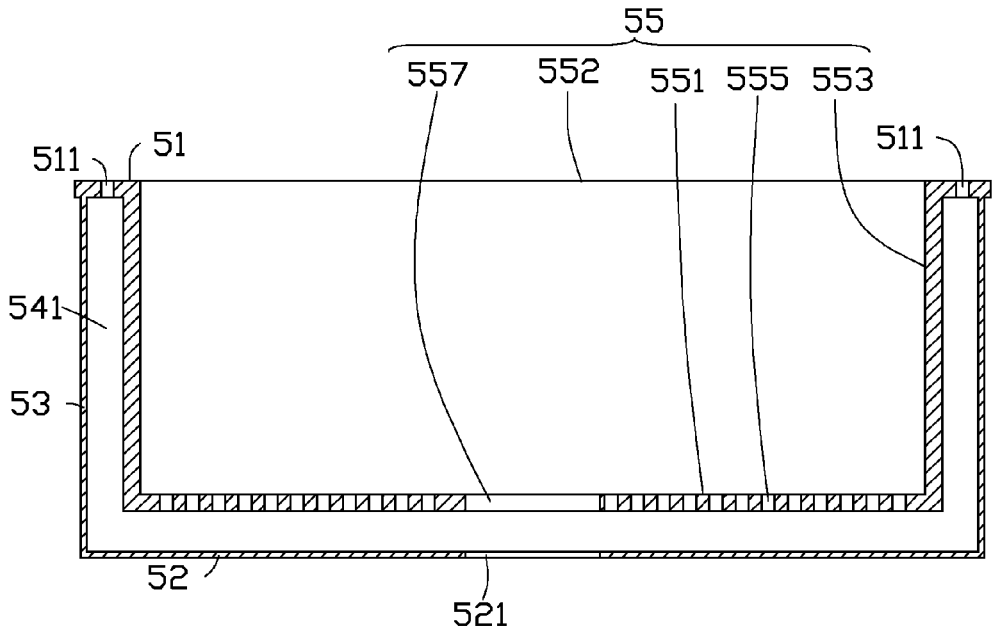
FIG. 4 is a cross-sectional view of the packing case of FIG. 2 taken along line IV-IV.
Figure 5:
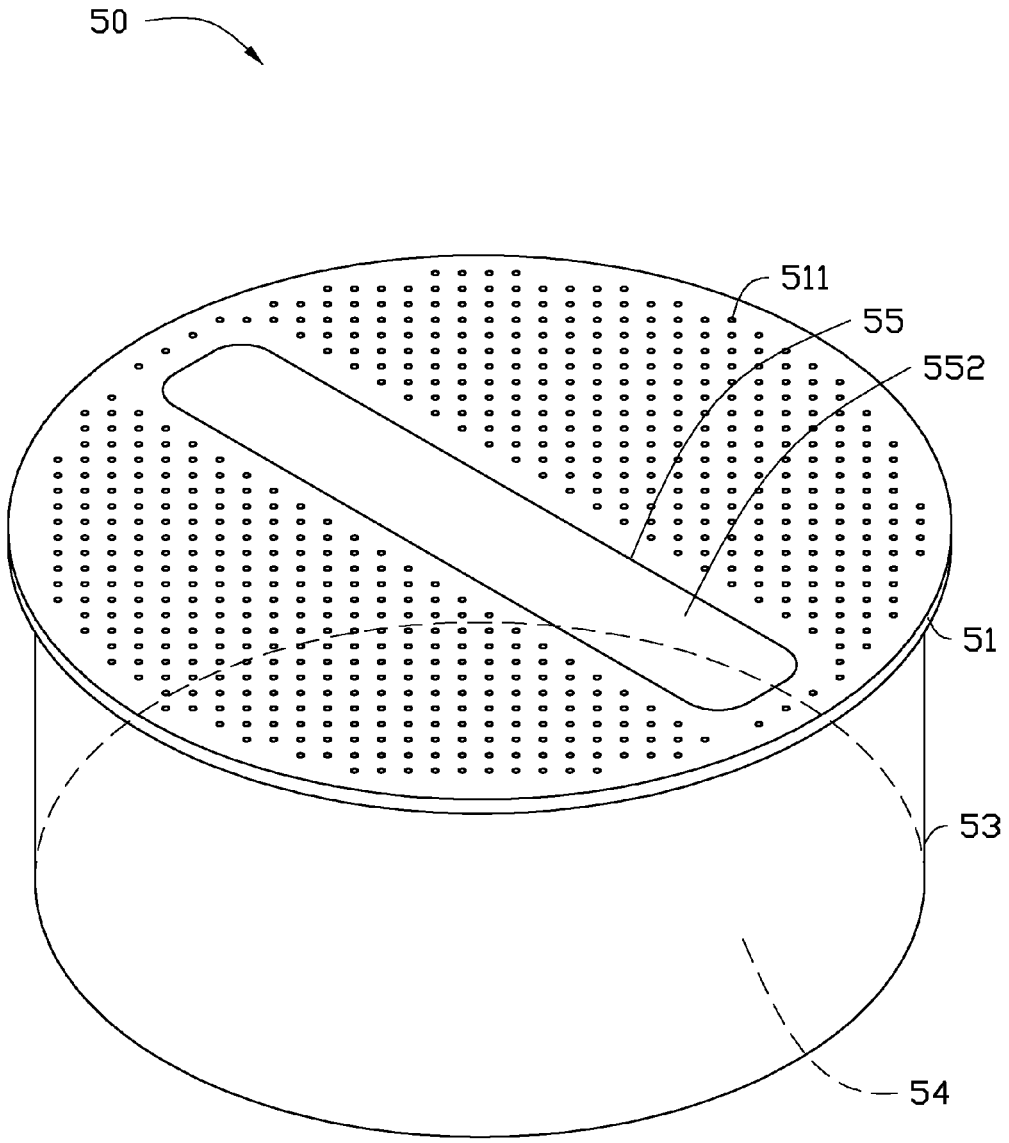
FIG. 5 is an enlarged view of the volume amplifying body of the packing case as shown in FIG. 2.

FIGS. 1-2 show an exemplary embodiment of a portable electronic device packing case 100 (hereinafter "the packing case 100") for receiving a portable electronic device 90 (hereinafter "the electronic device 90"). The packing case 100 includes a packing body 10, a sealing assembly 30 for sealing the packing body 10, and a volume amplifying assembly 40 received in the packing body 10. The volume amplifying assembly 40 includes a volume amplifying body 50 and a receiving member 70. In one embodiment, the receiving member 70 is a substantially hollow cylinder, and the volume amplifying body 50 is received in the receiving member 70.

In one embodiment, the packing body 10 is also a substantially hollow cylinder.

The sealing assembly 30 includes a first cover 31 and a second cover 33. The first cover 31 seals a first end of the packing body 10, and the second cover 33 seals a second end of the packing body 10.

The first cover 31 includes a first covering body 311 and a first catching portion 313 connected substantially perpendicularly to the first covering body 311. The first covering body 311 has a diameter larger than a diameter of the packing body 10. The first catching portion 313 has a diameter less than the diameter of the packing body 10. Thus, the first catching portion 313 is received in the packing body 10, and the first covering body 311 pressingly engages an edge of the first end of the packing body 10, thereby holding the first cover 31 on the first end of the packing body 10.

The second cover 33 includes a second covering body 331 and a second catching portion 333 connected substantially perpendicularly to the second covering body 331. The second covering body 331 has a diameter larger than the diameter of the packing body 10, and the second catching portion 333 has a diameter less than the diameter of the packing body 10. Thus, the second catching portion 333 is received in the packing body 10, and the second covering body 331 pressingly engages an edge of the second end of the packing body 10, thereby holding the second cover 33 on the second end of the packing body 10.

In one embodiment, the packing body 10, the sealing assembly 30, and the volume amplifying body 50 are made of plastic.

FIGS. 2-5 show that the volume amplifying body 50 includes a top wall 51, a bottom wall 52, and a side wall 53 connected between the top wall 51 and the bottom wall 52. The top wall 51, the bottom wall 52, and the side wall 53 cooperatively define a cavity 54.

The top wall 51 has a diameter larger than a diameter of the receiving member 70. The top wall 51 defines a plurality of sound holes 511.

The volume amplifying body 50 further includes a supporting member 55 located in a substantially central portion of the amplifying body 50. The supporting member 55 includes a bottom surface 551 and a peripheral wall 553 connected substantially perpendicularly to the bottom surface 551, and a top surface (not labeled) of the supporting member 55 defines an opening 552 (see FIG. 5). The opening 552 is defined through the top wall 51. Thus, the electronic device 90 is partially received and positioned in the supporting member 55.

The bottom surface 551 of the supporting member 55 defines a first connecting opening 557 and a plurality of sound transmitting holes 555 surrounding the first connecting opening 557. The top wall 51, the bottom wall 52, the side wall 53, and the supporting member 55 cooperatively define a sound chamber 541. Sound emitted by the electronic device 90 passes through the sound transmitting holes 555 to the sound chamber 541 and resonates in the sound chamber 541, and then is transmitted through the sound holes 511 to the outside of the volume amplifying body 50 and of the electronic device 90. Because the sound resonates in the sound chamber 541, sound quality and volume of the electronic device 90 are improved.

The bottom wall 52 defines a second connecting opening 521 corresponding to the first connecting opening 557. When the electronic device 90 is received in the supporting member 55, a data wire (not shown), which connects to a power source (not shown) can pass through the second connecting opening 521 and the first connecting opening 557 to connect the electronic device 90 to the power source.

The bottom wall 52, the side wall 53, and the supporting member 55 of the volume amplifying body 50 are received in the receiving member 70, such that the top wall 51 of the volume amplifying body 50 abuts one end of the receiving member 70.

The receiving member 70 is supported by the second covering body 331 of the second cover 33. The receiving member 70 has extra space to receive other things, such as earphones, data wires, and the like. The receiving member 70 defines a through hole 71 for allowing a data wire to pass through to connect to power sources. In one embodiment, the receiving member 70 is made of solid fiberboard.

In assembly of the packing case 100, the volume amplifying body 50 is received in the receiving member 70, such that the top wall 51 abuts an end of the receiving member 70. The receiving member 70 is positioned on the second covering body 331 of the second cover 33, and the electronic device 90 is received in the supporting member 55. Then, the packing body 10 receives the second catching portion 333 of the second cover 33, such that the peripheral edge of the second covering body 331 pressingly engages the second end of the packing body 10. Thus, the volume amplifying body 50, the receiving member 70, the second catching portion 333, and the electronic device 90 are received in the packing body 10. Finally, the first cover 31 covers the first end of the packing body 10.

In other embodiments, the volume amplifying body 50 and the receiving member 70 can be integrally formed.

In other embodiments, the peripheral wall 553 of the supporting member 55 can also define the sound transmitting holes 555.

Figure 6:
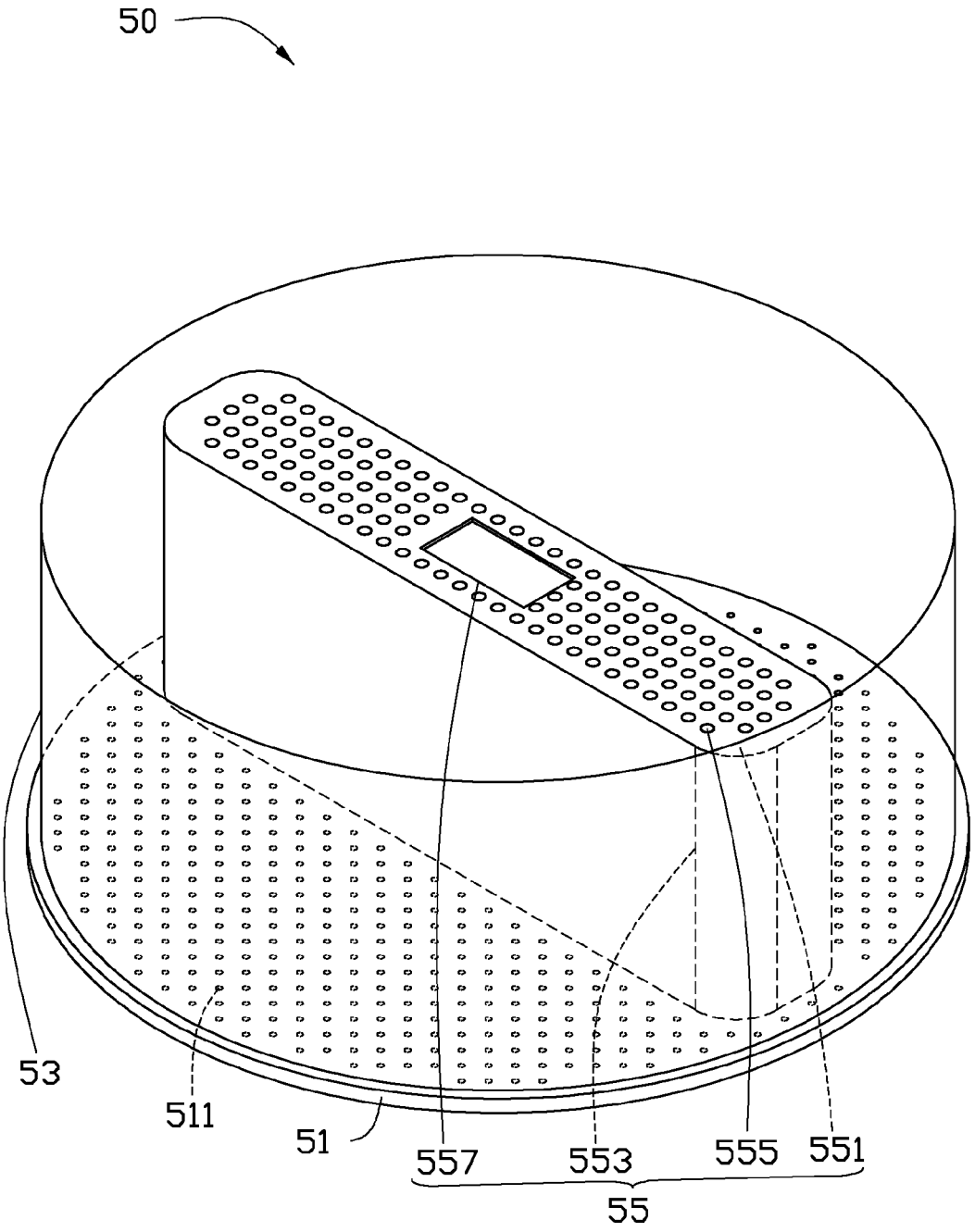
FIG. 6 is an enlarged view of another embodiment of a volume amplifying body.

FIG. 6 shows that the bottom wall 52 of the volume amplifying body 50 can be removed.

It is believed that the exemplary embodiment and its advantages will be understood from the foregoing description, and it will be apparent that various changes may be made thereto without departing from the spirit and scope of the disclosure or sacrificing all of its advantages, the examples hereinbefore described merely being preferred or exemplary embodiment of the disclosure.

What is claimed is:

1. A volume amplifying assembly, comprising:

a volume amplifying body, the volume amplifying body comprising:

a top wall formed on one end of the volume amplifying body, the top wall defining a plurality of sound holes therein;

a side wall connecting to the top wall;

a bottom wall connecting to the side wall, the top wall, the bottom wall, and the side wall cooperatively define a cavity; and a supporting member for supporting a portable electronic device positioned in the volume amplifying body, the supporting member comprising a bottom surface away from the top wall defining a plurality of sound transmitting holes;

the top wall, the bottom wall, the side wall, and the supporting member cooperatively defining a sound chamber, the sound emitted by the portable electronic device transmitting through the sound transmitting holes to the sound chamber, and then transmitting to the outside through the sound holes of the top wall.

2. The volume amplifying assembly as claimed in claim 1, wherein the supporting member comprises a bottom surface, a peripheral wall connecting the bottom surface, and a top surface defining an opening, at least one of the bottom surface or the peripheral wall defines the sound transmitting holes, the opening is defined through the top wall, allowing the portable electronic device to be received in the supporting member through the opening.

3. The volume amplifying assembly as claimed in claim 2, wherein the volume amplifying assembly further comprises a receiving member, the bottom wall, the side wall, and the supporting member are received in the receiving member, the top wall abuts an end of the receiving member.

4. The volume amplifying assembly as claimed in claim 3, wherein the bottom surface of the supporting member defines a first connecting opening, the bottom wall defines a second connecting opening corresponding to the first connecting opening, the first and second connecting openings are for data wires to pass through to connect the portable electronic device.

5. The volume amplifying assembly as claimed in claim 4, wherein the receiving member defines a through hole for the data wire connecting to the portable electronic device to pass through.

6. A portable electronic device packing case, comprising:

a packing body; and a volume amplifying assembly received in the packing body, the volume amplifying assembly comprising:

a volume amplifying body, the volume amplifying body comprising:

a top wall formed on one end of the volume amplifying body, the top wall defining a plurality of sound holes therein;

a side wall connecting to the top wall;

a bottom wall connecting to the side wall, the top wall, the bottom wall, and the side wall cooperatively define a cavity; and a supporting member for supporting a portable electronic device positioned in the volume amplifying body, the supporting member comprising a bottom surface away from the top wall defining a plurality of sound transmitting holes;

the top wall, the bottom wall, the side wall, and the supporting member cooperatively defining a sound chamber, the sound emitted by the portable electronic device transmitting through the sound transmitting holes to the sound chamber, and then transmitting to the outside through the sound holes of the top wall.

7. The packing case as claimed in claim 6, wherein the packing case further comprises a sealing assembly, the sealing assembly comprises a first cover and a second cover, the first cover covers a first end of the packing body, and the second cover covers a second end of the packing body.

8. The packing case as claimed in claim 7, wherein the first cover comprises a first covering body and a first catching portion connecting to the first covering body, the first catching portion is caught in the packing body, the first covering body abuts the first end of the packing body.

9. The packing case as claimed in claim 8, wherein the second cover comprises a second covering body and a second catching portion connecting to the second covering body, the second catching portion is caught in the packing body, the second covering body abuts the second end of the packing body.

10. The packing case as claimed in claim 6, wherein the supporting member comprises a bottom surface, a peripheral wall connecting the bottom surface, and a top surface defining an opening, at least one of the bottom surface or the peripheral wall defines the sound transmitting holes, the opening is defined through the top wall, allowing the portable electronic device to be received in the supporting member through the opening.

11. The packing case as claimed in claim 6, wherein the volume amplifying assembly further comprises a receiving member received in the packing body, the volume amplifying body is received in the receiving member.

12. The packing case as claimed in claim 7, wherein the packing body, the sealing assembly, and the volume amplifying body are made of plastic.

13. The packing case as claimed in claim 11, wherein the receiving member is made of a solid fiberboard.

14. A portable electronic device packing case, comprising:

a packing body; and a volume amplifying assembly received in the packing body, the volume amplifying assembly comprising:

a volume amplifying body, the volume amplifying body comprising:

a top wall formed on one end of the volume amplifying body, the top wall defining a plurality of sound holes therein;

a side wall connecting to the top wall;

a supporting member for supporting a portable electronic device positioned in the volume amplifying body, the supporting member comprising a bottom surface away from the top wall defining a plurality of sound transmitting holes;

the top wall, the side wall, and the supporting member cooperatively defining a sound chamber, the sound emitted by the portable electronic device transmitting through the sound transmitting holes to the sound chamber, and then transmitting to the outside through the sound holes of the top wall; and a sealing assembly, the sealing assembly comprising a first cover and a second cover, the first cover covering a first end of the packing body, and the second cover covering a second end of the packing body.

15. The packing case as claimed in claim 14, wherein the first cover comprises a first covering body and a first catching portion connecting to the first covering body, the first catching portion is caught in the packing body, the first covering body abuts the first end of the packing body.

16. The packing case as claimed in claim 14, wherein the second cover comprises a second covering body and a second catching portion connecting to the second covering body, the second catching portion is caught in the packing body, the second covering body abuts the second end of the packing body.

17. The packing case as claimed in claim 14, wherein the supporting member comprises a bottom surface, a peripheral wall connecting the bottom surface, and a top surface defining an opening, at least one of the bottom surface or the peripheral wall defines the sound transmitting holes, the opening is defined through the top wall, allowing the portable electronic device to be received in the supporting member through the opening.

18. The packing case as claimed in claim 14, wherein the volume amplifying assembly further comprises a receiving member received in the packing body, the volume amplifying body is received in the receiving member.

19. The packing case as claimed in claim 14, wherein the packing body, the sealing assembly, and the volume amplifying body are made of plastic.

20. The packing case as claimed in claim 18, wherein the receiving member is made of a solid fiberboard.

* * * * *